US006408479B1

(12) United States Patent
Pinney

(10) Patent No.: US 6,408,479 B1
(45) Date of Patent: Jun. 25, 2002

(54) ARTICULATED PAINT ROLLER ASSEMBLY

(76) Inventor: Steve B. Pinney, 28053 Lakehurst Ave., Canyon Country, CA (US) 91351

( * ) Notice: Subject to any disclaimer, the term of this patent is extended or adjusted under 35 U.S.C. 154(b) by 0 days.

(21) Appl. No.: 09/544,867

(22) Filed: Apr. 7, 2000

Related U.S. Application Data

(60) Provisional application No. 60/128,616, filed on Apr. 8, 1999.

(51) Int. Cl.[7] ..... B05C 17/02

(52) U.S. Cl. ..... 15/230.11; 15/144.1; 492/13; 492/19

(58) Field of Search ..... 15/144.1, 144.2, 15/172, 230.11; 492/13, 19

(56) References Cited

U.S. PATENT DOCUMENTS

| | | | | | |
|---|---|---|---|---|---|
| 2,348,972 | A | * | 5/1944 | Gray | 15/172 |
| 2,613,384 | A | * | 10/1952 | Collins | 15/172 |
| 3,803,662 | A | * | 4/1974 | Glejf | 15/144.1 X |
| 3,866,257 | A | * | 2/1975 | Cansdale, Sr. | 15/230.11 |
| 4,089,082 | A | * | 5/1978 | McGraw | 15/230.11 |
| 5,979,004 | A | * | 11/1999 | Wilson | 15/144.1 X |

FOREIGN PATENT DOCUMENTS

| | | | | |
|---|---|---|---|---|
| DK | 68712 | * | 3/1949 | 15/172 |

* cited by examiner

*Primary Examiner*—Mark Spisich
(74) *Attorney, Agent, or Firm*—Kelly Bauerfeld Lowry & Kelley, LLP

(57) ABSTRACT

A paint roller assembly includes an elongated shaft, an articulated paint application assembly disposed at one end of the shaft, and an actuator connected to the articulated paint application assembly and extending through the shaft to a handle at an opposite end of the shaft. A portion of the shaft adjacent to the articulated paint assembly is angled to facilitate wetting of the roller with paint. The articulated assembly includes a roller frame interconnected between a joint mechanism and a roller supporting cage. The actuator includes a rod interconnected between the handle and a joint mechanism of the articulated paint application assembly. The joint mechanism provides rotational movement of the roller frame. In one form of the invention, the joint mechanism includes a universal joint. In another form, the joint mechanism includes miter gears. The handle has an inner diameter greater than an outer diameter of the shaft so as to overlie the shaft, in part, and rotate about the shaft to rotate the rod and cause movement of the articulated paint application assembly.

34 Claims, 3 Drawing Sheets

ARTICULATED PAINT ROLLER ASSEMBLY

RELATED APPLICATION

This application claims priority from provisional application Serial No. 60/128,616 filed Apr. 8, 1999.

BACKGROUND OF THE INVENTION

The present invention pertains to paint rollers. More particularly, the present invention pertains to an articulated paint roller assembly which permits a painter to easily rotate the angle of a paint roller associated with an elongated shaft.

Commercially available paint rollers consist of a one-piece angular rolling frame shaft which is interconnected to a handle at one end and an axle cage over which the disposable roller may be placed at the other end. The roller is usually perpendicular to the handle. Many painters prefer to use paint rollers rather than brushes as paint rollers are generally easier to use than brushes. For example, more paint can be loaded onto the paint roller than a brush and paint rollers do not leave brush strokes. Moreover, paint rollers paint a broader area per stroke than brushes.

In operation, the paint roller is immersed in paint so as to cover the outer cylindrical surface of the paint roller. The painter then applies the paint to a wall or other surface by pressing and rolling the paint roller across the surface to be painted.

The traditional paint roller is satisfactory for large flat surfaces, however, the traditional paint roller has drawbacks when painting near the floor or ceiling and when approaching corners between walls and the ceiling and other awkward areas. In this regard, the paint roller is unable to paint within the corners because the fixed roller pivots away from the wall at awkward angles, resulting in uneven painting and at times requiring the use of paint brushes to finish the painting job. Oftentimes, the painter must kneel down on the floor or stand on a ladder to position himself or herself at an angle in which the paint roller may be rolled flush with the painting surface. These problems are also encountered when painting gables, dormers, and other exterior facia boards.

Various attempts have been made to solve these problems by devising paint rollers which are angularly adjustable. However, these attempts all suffer drawbacks in that they are all complicated and time consuming. Many require the laborious manual loosening and adjusting of mechanisms associated with the paint roller to set the angle of the paint roller for each angle to be painted. Some of these devices require the use of tools in order to loosen, or even dismantle, the device before readjustment. The very specific angle selected may prevent the painter from reloading the paint roller with paint without first readjusting the device to its original orientation.

Therefore, what is needed is a paint roller assembly that is articulated so as to enable the rotation of the paint roller relative to a handle shaft, in order to facilitate painting near floors, ceilings and corners. Such an articulated assembly should be adjustable without the need of tools or the repeated manual loosening and readjustment of mechanisms. The present invention fulfills these needs and provides other related advantages.

SUMMARY OF THE INVENTION

The present invention resides in a paint roller assembly that is articulated so as to permit the painter using the assembly to easily adjust the angle and position of the paint roller relative to a handle shaft, facilitating painting of large flat surfaces as well as awkward areas such as areas near floors, ceilings and corners. The paint roller assembly generally comprises an elongated shaft, an articulated paint application assembly disposed at one end of the shaft, and an actuator connected to the articulated paint application assembly and extending through the shaft to a handle at an opposite end of the shaft.

The articulated assembly includes a roller frame interconnected between a joint mechanism and a roller supporting cage. The joint mechanism provides rotational movement of the roller frame. In one form of the invention, the joint mechanism comprises a universal joint. In another form, the joint mechanism comprises miter gears each having radial teeth which interfit so as to provide rotation to one gear in response to rotation of another.

The actuator comprises a rod interconnected between the handle and the joint mechanism of the articulated paint application assembly. The handle has an inner diameter slightly greater than an outer diameter of the shaft so as to overly the shaft, at least in part, and rotate about the shaft to activate the actuator.

Rotation of the handle causes movement of the articulated paint application assembly. More particularly, rotating the handle causes the attached rod to rotate resulting in the rotation of the roller frame. In this way the roller can be rotated to the necessary angle and allowed to pivot in response to awkward angles.

Preferably, a portion of the shaft adjacent the articulated paint assembly is angled to facilitate wetting of the roller with paint. The joint mechanism is disposed within the angled portion of the shaft in order to provide rotational interplay between the roller frame and inner rod as described.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 6:
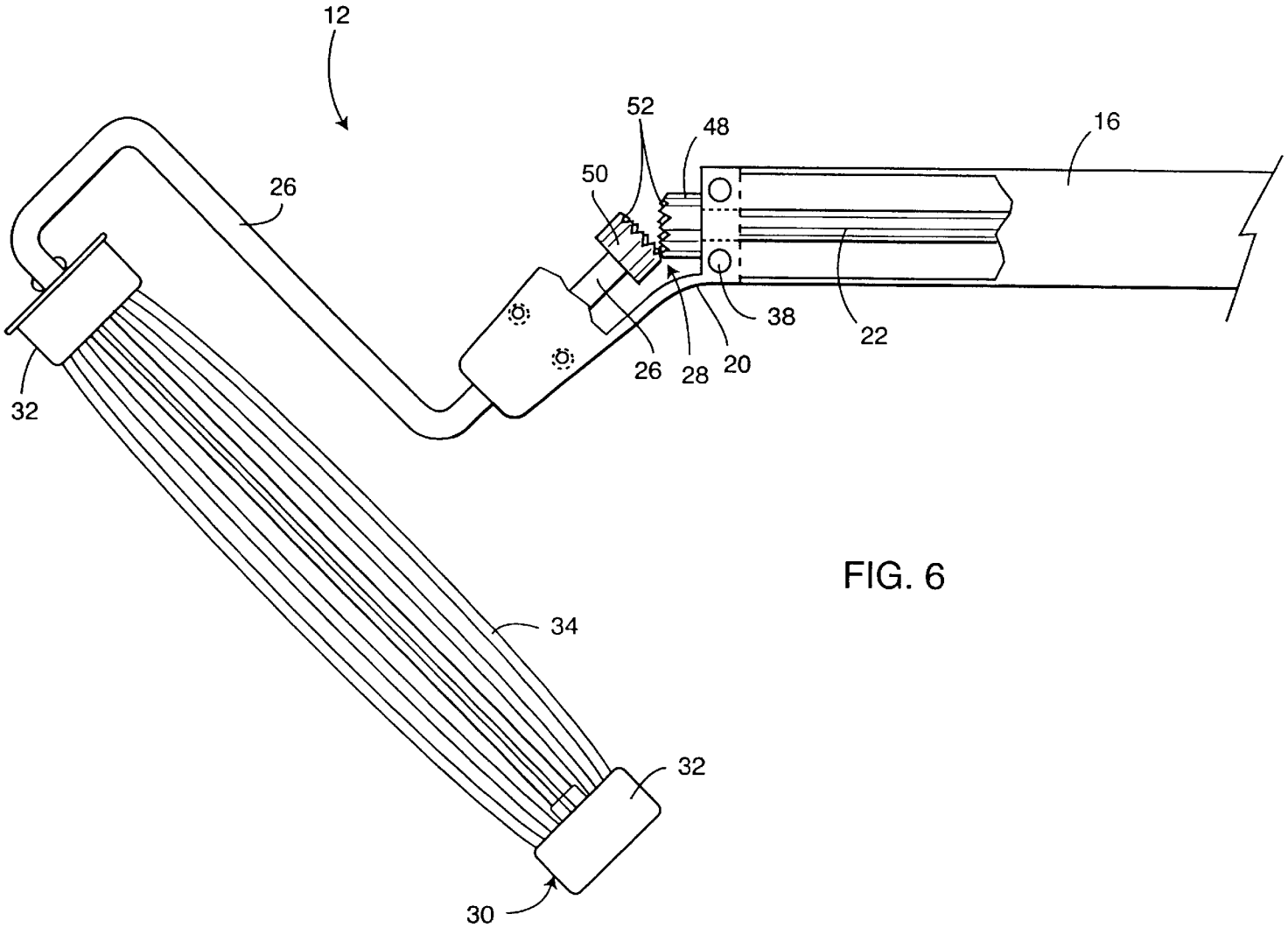
FIG. 6 is a partially fragmented and cut-away view of another paint roller assembly embodying the present invention, wherein the joint mechanism includes miter gears having interfitting radial teeth.

The present invention resides in an articulated paint roller assembly, generally referred to in the accompanying drawings by the reference number 10 in FIGS. 1–4, and by the reference number 12 in FIG. 6. The paint roller assemblies 10 and 12 allow a painter to paint at varying angles without the cumbersome work stoppage required to loosen and readjust mechanisms used in prior paint roller assemblies.

Figure 1:
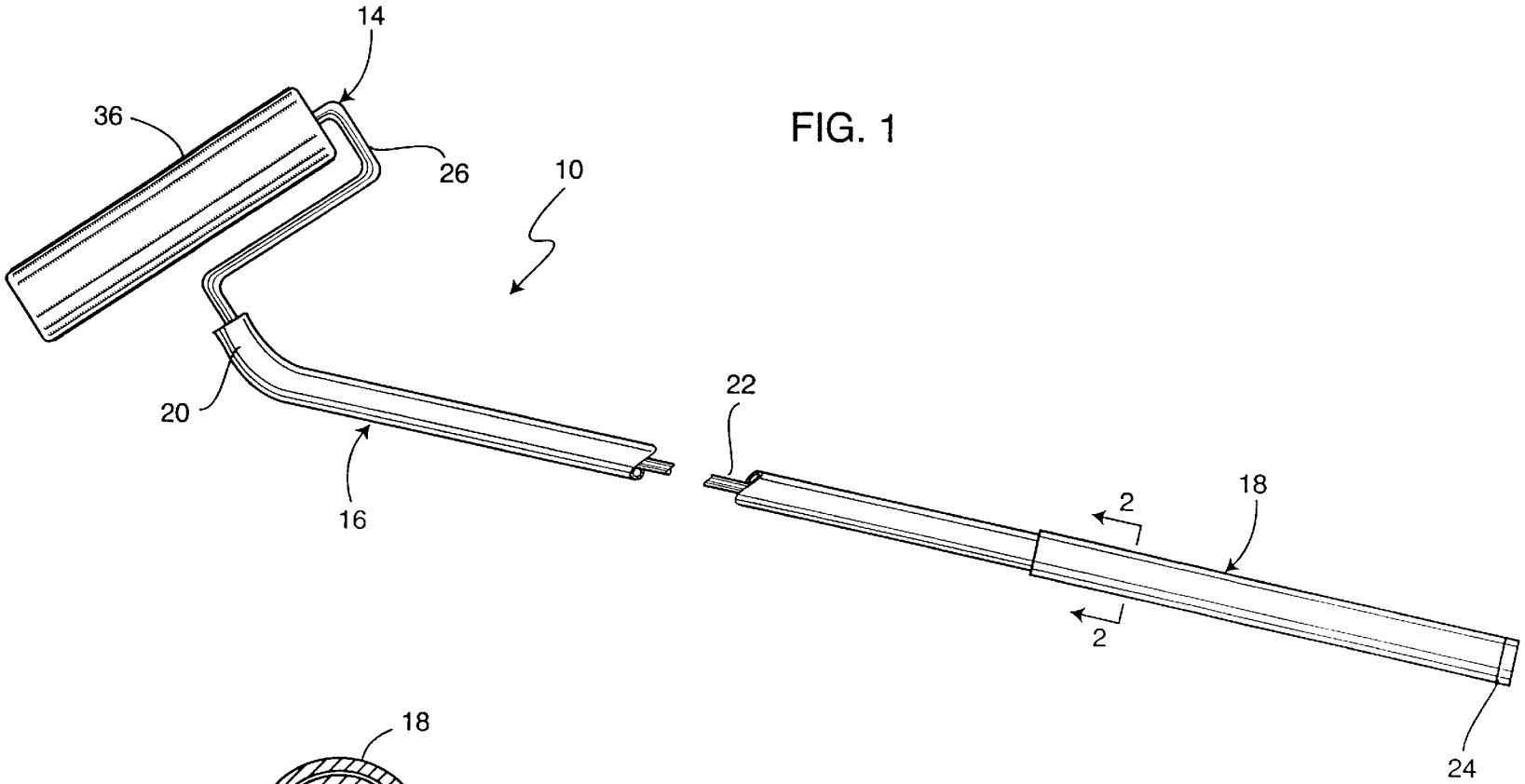
FIG. 1 is a partially fragmented elevational view of a paint roller assembly embodying the present invention.
Figure 2:
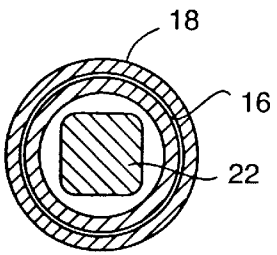
FIG. 2 is a cross-sectional view taken generally along line 2—2 of FIG. 1, illustrating the relationship between an outer handle, shaft and inner rod of the paint roller assembly.

Referring to FIGS. 1 and 2, the paint roller assembly 10 generally comprises an articulated paint application assembly 14 at one end of a hollow shaft 16, and a handle 18 disposed at the other end of the shaft 16. The length of the shaft 16 is typically four to five feet to allow the painter to load the paint application assembly 14 while standing, although the shaft can be provided in various lengths dictated by painter needs. A portion 20 of the shaft 16 is angled, preferably a 45° angle, to facilitate wetting the paint application assembly 14 with paint contained in a pan adapted for paint roller use and placed on the ground or other flat surface. The angled shaft portion 20 also aids in painting both high and low surfaces of a wall or the like.

A rod 22 is attached to a closed end 24 of the handle 18 and extends through the shaft 16 to the paint application assembly 14. As shown in FIG. 2, the inner diameter of the handle 18 is slightly larger than the outer diameter of the shaft 16 so that the handle 18 can overlie the shaft 16 and be rotated with respect to the shaft 16. The rod 22 is free to rotate within the shaft 16 in response to rotation of the handle 18. As the rod 22 is connected to the paint application assembly 14, when the rod 22 is rotated the paint roller assembly 14 is similarly rotated as will be further described.

Figure 3:
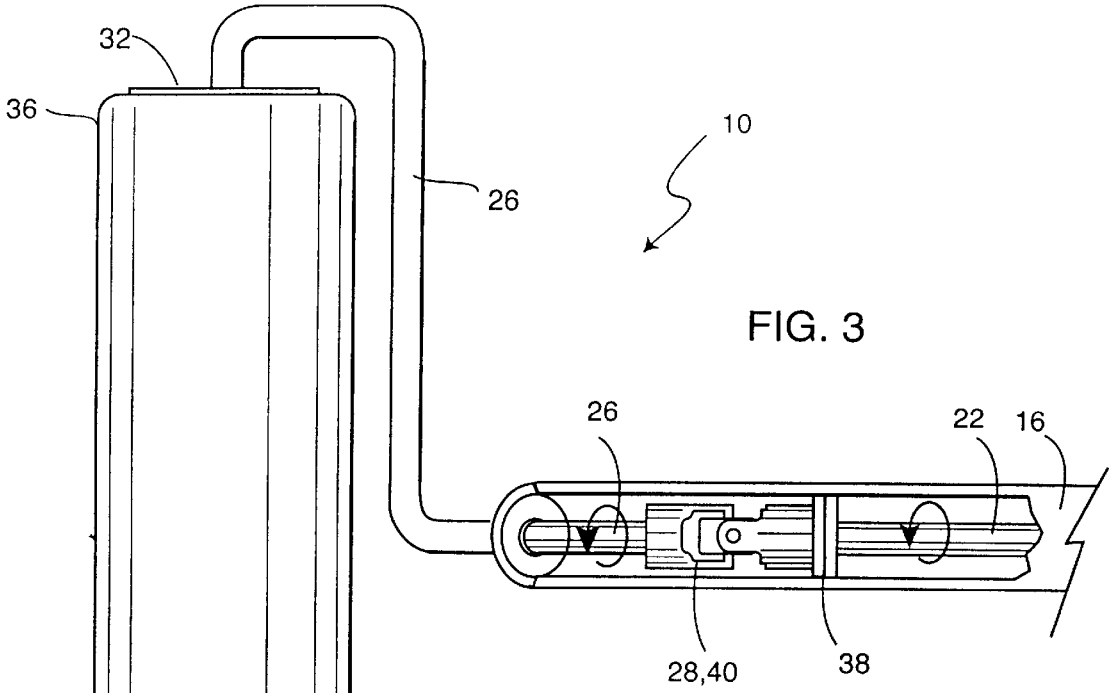
FIG. 3 is a partially fragmented elevational view of the paint roller assembly of FIG. 1, having a cut-away view which illustrates an internal universal joint mechanism disposed within the shaft and interconnected between a paint application assembly and the rod.
Figure 4:
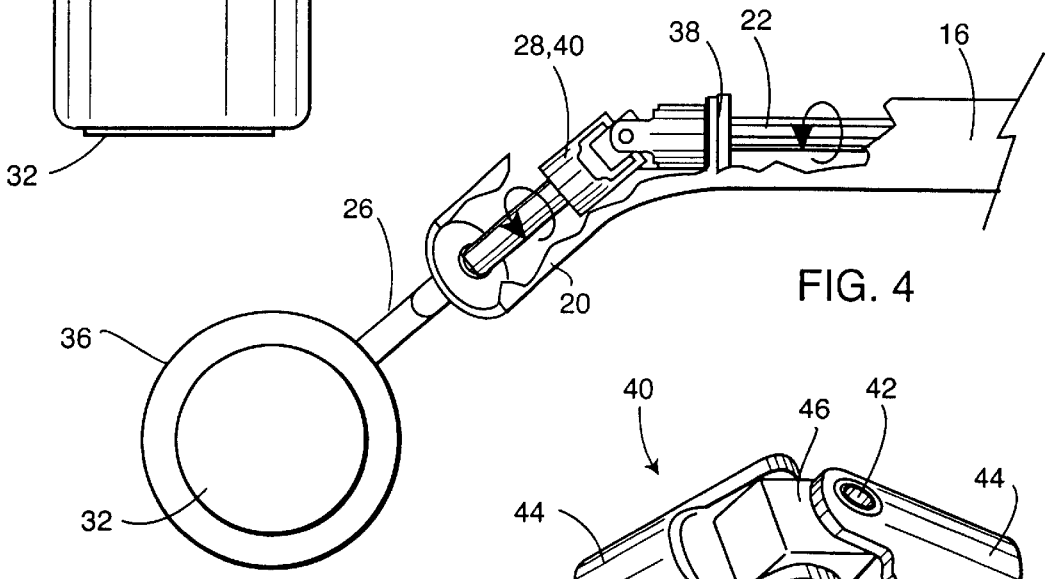
FIG. 4 is side view of FIG. 3.
Figure 5:
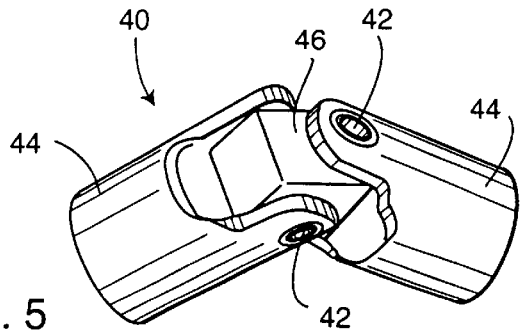
FIG. 5 is an enlarged perspective view of the universal joint mechanism of FIGS. 3 and 4.

Referring to FIGS. 3–5, the paint application assembly 14 is comprised of a roller frame 26 which is interconnected between a joint mechanism 28 and a roller supporting cage 30. As is standard in the industry, the roller frame 26 is generally "U" shaped so that the primary axis of the roller cage 30 remains perpendicular to the primary axis of the shaft 16 to allow the application of paint to a surface to be painted with movement of the shaft 16.

The roller cage 30 is independently rotatable with respect to the roller frame 26 by means well known in the art. The roller cage 30 includes end plugs 32 interconnected by wire spindles 34. The wire spindles 34 bulge slightly outward between the end plugs 32. When a roller 36 is attached to the roller cage 30, the wire spindles 34 are somewhat compressed and aid in holding the roller 36 in place. The roller 36 is of a type well known in the art and has an outer surface capable of retaining and subsequently delivering paint to a surface to be painted.

The joint mechanism 28 is held in place within the angled portion 20 of the shaft 16 by an internal support 38 disposed in or formed with the shaft 16. The rod 22 extends through the support 38 for connection to the joint mechanism 28, and the joint mechanism 28 is allowed to rotate relative to the support 38 in response to rotation of the rod 22.

In a preferred embodiment illustrated in FIGS. 3–5, the joint mechanism 28 comprises a universal joint 40 having one end thereof connected to the support 38 and the other end thereof connected to the roller frame 26. The universal joint 40 transmits the rotary motion of the rod 22 to the roller frame 26 even though the roller frame 26 is not aligned with the rod 22. Preferably, pivot axes 42 of U-shaped couplings 44 of the universal joint 40 intersect perpendicular to one another, typically through a block 46 or similar structure, to prevent undesirable side to side motion of the joint 40 during operation.

The joint mechanism 28 of the invention is not limited to a universal joint 40, but may be any joint capable of allowing rotation of the roller frame 26 in response to rotation of the rod 22. In this regard, another form of the joint mechanism 28 is illustrated in FIG. 6, wherein a first miter gear 48 is rotatably secured to the support 38 and rod 22, and a second miter gear 50 is connected to the roller frame 26. The miter gears 48 and 50 each have radial teeth 52 which interfit so that when the rod 22 rotates the first miter gear 48, the second miter gear 50, and thus the roller frame 26, is similarly rotated.

In use, the painter can rotate the paint roller assembly 14 to a desired angle to match the surface to be painted by merely grasping and rotating the handle 18 with his or her hand. The rotation of the handle 18 rotates the internal rod 22 which in turn acts upon the joint mechanism 28 to similarly rotate the roller frame 26 and thus the paint roller 36 to the desired angle.

Thus, the roller 36 can be rotated one direction to paint the left corner of a wall and then rotated in the opposite direction to paint the right corner of the same wall. The painter can also rotate the handle 18 so that the roller 36 is positioned such that horizontal strokes can be used near ceilings and floors without the use of ladders or the need for the painter to kneel and reposition the paint roller 36 so that it paints flush with the painting surface. The painter can also paint a broad surface in the vertical plane. The paint roller assemblies 10 and 12 may be used with an extended shaft 16 in order to alleviate bending down to load the roller 36 with paint and paint lower surfaces. The roller assemblies 10 and 12 also eliminate the need to use step stools or ladders to reach higher portions of walls.

Although several embodiments have been described in detail for purposes of illustration, various modifications may be made without departing from the scope and spirit of the invention. Accordingly, the invention is not to be limited, except as by the appended claims.

What is claimed is:

1. A paint roller assembly, comprising:

an elongated shaft;

an articulated paint application assembly disposed at one end of the shaft; and an actuator connected to the articulated paint application assembly and extending through the shaft to a handle at an opposite end of the shaft, wherein rotation of the handle causes movement of the articulated paint application assembly;

wherein a portion of the shaft adjacent the articulated paint application assembly is angled.

2. The assembly of claim 1, wherein the articulated paint application assembly includes a joint mechanism.

3. The assembly of claim 2, wherein the articulated paint application assembly includes a roller frame interconnected between the joint mechanism and a roller supporting cage.

4. The assembly of claim 3, wherein the joint mechanism provides rotational movement of the roller frame in response to rotation of the handle.

5. The assembly of claim 2, wherein the joint mechanism comprises a universal joint.

6. The assembly of claim 2, wherein the joint mechanism comprises miter gears having interfitting radial teeth.

7. The assembly of claim 6, wherein the miter gears are capable of pivoting relative to one another and rotating in response to the rotation of the other.

8. The assembly of claim 1, wherein the actuator comprises a rod interconnected between the handle and the articulated paint application assembly.

9. The assembly of claim 1, wherein the handle has an inner diameter of greater width than an outer diameter of the shaft so as to overlie the shaft and rotate about the shaft to activate the actuator.

10. The assembly of claim 1, wherein a joint mechanism of the articulated paint application assembly is disposed within the angled portion of the shaft.

11. A paint roller assembly, comprising:

an elongated shaft;

an articulated paint application assembly disposed at one end of the shaft and including a joint mechanism; and a roller frame interconnected between the joint mechanism and a roller supporting cage; and an actuator including a rod connected to the joint mechanism and extending through the shaft to a handle at an opposite end of the shaft, wherein rotation of the handle causes the rod to rotate resulting in movement of the articulated paint application assembly.

12. The assembly of claim 11, wherein the joint mechanism provides rotational movement to the roller frame.

13. The assembly of claim 11, wherein the joint mechanism comprises a universal joint.

14. The assembly of claim 11, wherein the joint mechanism comprises miter gears having interfitting radial teeth, the miter gears being capable of pivoting relative to one another and rotating in response to the rotation of the other.

15. The assembly of claim 11, wherein the handle has an inner diameter of greater width than an outer diameter of the shaft so as to overlie the shaft, in part, and rotate about the shaft to rotate the rod.

16. The assembly of claim 11, wherein a portion of the shaft adjacent the articulated paint application assembly is angled and the joint mechanism is disposed therein.

17. A paint roller assembly, comprising:

an elongated shaft having an angled portion;

an articulated paint application assembly including a roller frame interconnected between a roller supporting cage and a joint mechanism disposed within the angled portion of the shaft; and an actuator including a rod connected to the joint mechanism and extending through the shaft to a handle at an opposite end of the shaft, the handle having an inner diameter of greater width than an outer diameter of the shaft so as to overlie the shaft, in part, and rotate about the shaft to rotate the rod, wherein rotation of the handle results in similar rotation of the rod causing the joint mechanism to provide a similar rotational movement to the roller frame.

18. The assembly of claim 17, wherein the joint mechanism comprises a universal joint.

19. The assembly of claim 17, wherein the joint mechanism comprises miter gears having interfitting radial teeth, the miter gears being capable of pivoting relative to one another and rotating in response to the rotation of the other.

20. A paint roller assembly, comprising:

an elongated shaft;

an articulated paint application assembly disposed at one end of the shaft and including a roller frame interconnected between a joint mechanism and a roller supporting cage; and an actuator connected to the articulated paint application assembly and extending through the shaft to a handle at an opposite end of the shaft, wherein rotation of the handle causes movement of the articulated paint application assembly.

21. The assembly of claim 20, wherein the joint mechanism provides rotational movement of the roller frame in response to rotation of the handle.

22. The assembly of claim 20, wherein the actuator comprises a rod interconnected between the handle and the articulated paint application assembly.

23. The assembly of claim 20, wherein the handle has an inner diameter of greater width than an outer diameter of the shaft so as to overlie the shaft and rotate about the shaft to activate the actuator.

24. The assembly of claim 20, wherein a portion of the shaft adjacent the articulated paint application assembly is angled, and wherein the joint mechanism is disposed within the angled portion of the shaft.

25. A paint roller assembly, comprising:

an elongated shaft;

an articulated paint application assembly disposed at one end of the shaft; and including a universal joint mechanism; and an actuator connected to the articulated paint application assembly and extending through the shaft to a handle at an opposite end of the shaft, wherein rotation of the handle causes movement of the articulated paint application assembly.

26. The assembly of claim 25, wherein the articulated paint application assembly includes a roller frame interconnected between the universal joint mechanism and a roller supporting cage.

27. The assembly of claim 25, wherein the actuator comprises a rod interconnected between the handle and the articulated paint application assembly.

28. The assembly of claim 25, wherein the handle has an inner diameter of greater width than an outer diameter of the shaft so as to overlie the shaft and rotate about the shaft to activate the actuator.

29. The assembly of claim 25, wherein a portion of the shaft adjacent the articulated paint application assembly is angled, and wherein the joint mechanism is disposed within the angled portion of the shaft.

30. A paint roller assembly, comprising:

an elongated shaft;

an articulated paint application assembly disposed at one end of the shaft; including a joint mechanism comprised of miter gears having interfitting radial teeth; and an actuator connected to the articulated paint application assembly and extending through the shaft to a handle at an opposite end of the shaft, wherein rotation of the handle causes movement of the articulated paint application assembly.

31. The assembly of claim 30, wherein the articulated paint application assembly includes a roller frame interconnected between the joint mechanism and a roller supporting cage.

32. The assembly of claim 30, wherein the actuator comprises a rod interconnected between the handle and the articulated paint application assembly.

33. The assembly of claim 30, wherein the handle has an inner diameter of greater width than an outer diameter of the shaft so as to overlie the shaft and rotate about the shaft to activate the actuator.

34. The assembly of claim 30, wherein a portion of the shaft adjacent the articulated paint application assembly is angled, and wherein the joint mechanism is disposed within the angled portion of the shaft.

* * * * *